US005718026A

United States Patent [19]

Harrison et al.

[11] Patent Number: 5,718,026

[45] Date of Patent: Feb. 17, 1998

[54] ADJUSTABLE ATTACHMENT DEVICE FOR SUSPENDING AN OBJECT

[75] Inventors: Patrick N. Harrison, Aurora; Nenad B. Medjedovic, Downsview, both of Canada

[73] Assignee: Special Health Systems Ltd., Aurora, Canada

[21] Appl. No.: 748,251

[22] Filed: Nov. 12, 1996

Related U.S. Application Data

[63] Continuation of Ser. No. 337,484, Nov. 8, 1994, Pat. No. 5,573,302.

[51] Int. Cl.[6] ..... A44B 21/00

[52] U.S. Cl. ..... 24/580; 24/298; 24/68 CD; 24/176

[58] Field of Search ..... 24/580, 27, 4, 24/68 CD, 265 BC, 265 H, 265 CD, 298, 302, 176

[56] References Cited

U.S. PATENT DOCUMENTS

| | | | |
|---|---|---|---|
| 1,205,492 | 11/1916 | Swift | 24/580 |
| 1,490,527 | 4/1924 | Agee, Jr. | 24/580 X |
| 3,132,396 | 5/1964 | Berman | 24/27 |
| 3,685,778 | 8/1972 | Berns | 24/580 X |
| 3,977,047 | 8/1976 | Lege | 24/302 |
| 4,422,219 | 12/1983 | Kepiro | 24/176 |
| 4,769,875 | 9/1988 | Hartman | 24/300 |
| 4,909,466 | 3/1990 | Matthews | 24/27 X |
| 4,976,017 | 12/1990 | Frano | 24/580 X |
| 4,995,329 | 2/1991 | Kleine | 24/298 X |
| 5,193,955 | 3/1993 | Chou | 24/68 CD X |
| 5,299,851 | 4/1994 | Lin | 297/284.5 |
| 5,423,108 | 6/1995 | Brennan | 24/298 X |

FOREIGN PATENT DOCUMENTS 2040794 8/1971 Germany .

*Primary Examiner*—Peter M. Cuomo
*Assistant Examiner*—Robert J. Sandy

[57] ABSTRACT

An adjustable attachment has been developed which can be used in combination with an auxiliary backrest to suspend the backrest from a fixed backrest normally found on a chair or wheelchair. The support structure includes an elongate receiver and a hanger. The receiver extends longitudinally and is normally fixed in a vertical position to the auxiliary backrest and defines a plurality of openings spaced apart along the length of the receiver to form a row of openings. The hanger is shaped to fit in any one of the receiver openings and the receiver has an outer part so that in use the hanger can be engaged through a selected one of the openings. The hanger then extends along the length of the receiver and the outer part can be engaged downwardly over an upper edge of a fixed backrest or other support. The structure is also disclosed in combination with an adjustable auxiliary backrest having a resiliently deformable vertical spine and ribs having forwardly and outwardly end portions to give lateral support to the user.

10 Claims, 4 Drawing Sheets

ADJUSTABLE ATTACHMENT DEVICE FOR SUSPENDING AN OBJECT

This application is a Continuation of application Ser. No. 08/337,484, filed Nov. 8, 1994 U.S. Pat. No. 5,573,302.

FIELD OF THE INVENTION

This invention relates to an adjustable attachment particularly useful in hanging an auxiliary backrest from an existing fixed backrest.

BACKGROUND OF THE INVENTION

Although the invention will be described primarily for use to attach an auxiliary backrest to a fixed backrest in a chair, it will become evident that the adjustable attachment can be used for other purposes.

Persons who are forced to sit for long periods of time have discovered that they can improve their posture by enhancing the seat structure with the use of adjustable backrests. Such people range from clerical workers to the disabled and a variety of different types of backrests have been developed for these purposes. It will be evident that for a backrest to be suitable for a range of purposes, it should preferably be adjustable not only in terms of its shape, but also in terms of the height where it is positioned on the chair. If both adjustments are provided, then a great variety of users can be accommodated and the backrest can be adjusted as the user's needs change.

SUMMARY OF THE INVENTION

In order to enhance auxiliary backrests, an adjustable attachment has been developed which can be used in combination with the auxiliary backrest to suspend the backrest from a fixed backrest normally found on a chair or wheelchair. The support structure includes an elongate receiver which extends longitudinally and is normally fixed in a vertical position to the auxiliary backrest and defines a plurality of openings spaced apart along the length of the receiver to form a row of openings. The receiver includes structure for coupling the receiver to the backrest or other object at both sides of the row of openings. A hanger is provided having an inner part adapted to be engaged through a respective one of the openings and positionable longitudinally of the receiver, and a bridge is attached orthogonally to the hanger for positioning in one of these openings. With the inner part so positioned, an outer part which extends from the outer end of the bridge extends generally in parallel with the inner part so that in use the hanger can be engaged through a selected one of the openings until the bridge is positioned in the opening. The hanger then extends along the length of the receiver and the outer part can be engaged downwardly over an upper edge of a fixed backrest or other support. The adjustability vertically is provided by selecting one of the openings and engaging the hanger in that opening.

It is also part of the invention to provide a combination of an auxiliary backrest and an adjustable attachment for suspending the backrest from a chair having a fixed backrest and an upper edge on the fixed backrest. The auxiliary backrest normally is arranged to extend vertically and has a front, a back, a top and a bottom. The auxiliary backrest further includes a resiliently deformable vertical spine having a central portion and a plurality of laterally extending ribs having forwardly and outwardly end portions to give lateral support to the user. The spine further includes a cable anchor at the top of the of the spine and a sheath anchor at the bottom of the spine. The spine is resiliently deformable from a generally flat configuration and an actuator is provided including a controller, a sheath coupled at one end to the controller and extending to the sheath anchor, and a cable attached to the controller and extending through the sheath to the cable anchor. When the controller is operated, it changes the distance between the sheath and cable anchors to thereby vary the curvature of the spine to change the curvature of the auxiliary backrest. The adjustable attachment is coupled to the back of the auxiliary backrest to permit hanging the auxiliary backrest from an upper edge of the fixed backrest on the wheelchair.

BRIEF DESCRIPTION OF THE DRAWINGS

The features and advantages of the present invention will become more readily apparent from the following description, taken in combination with the drawings, in which.

Figure 1:
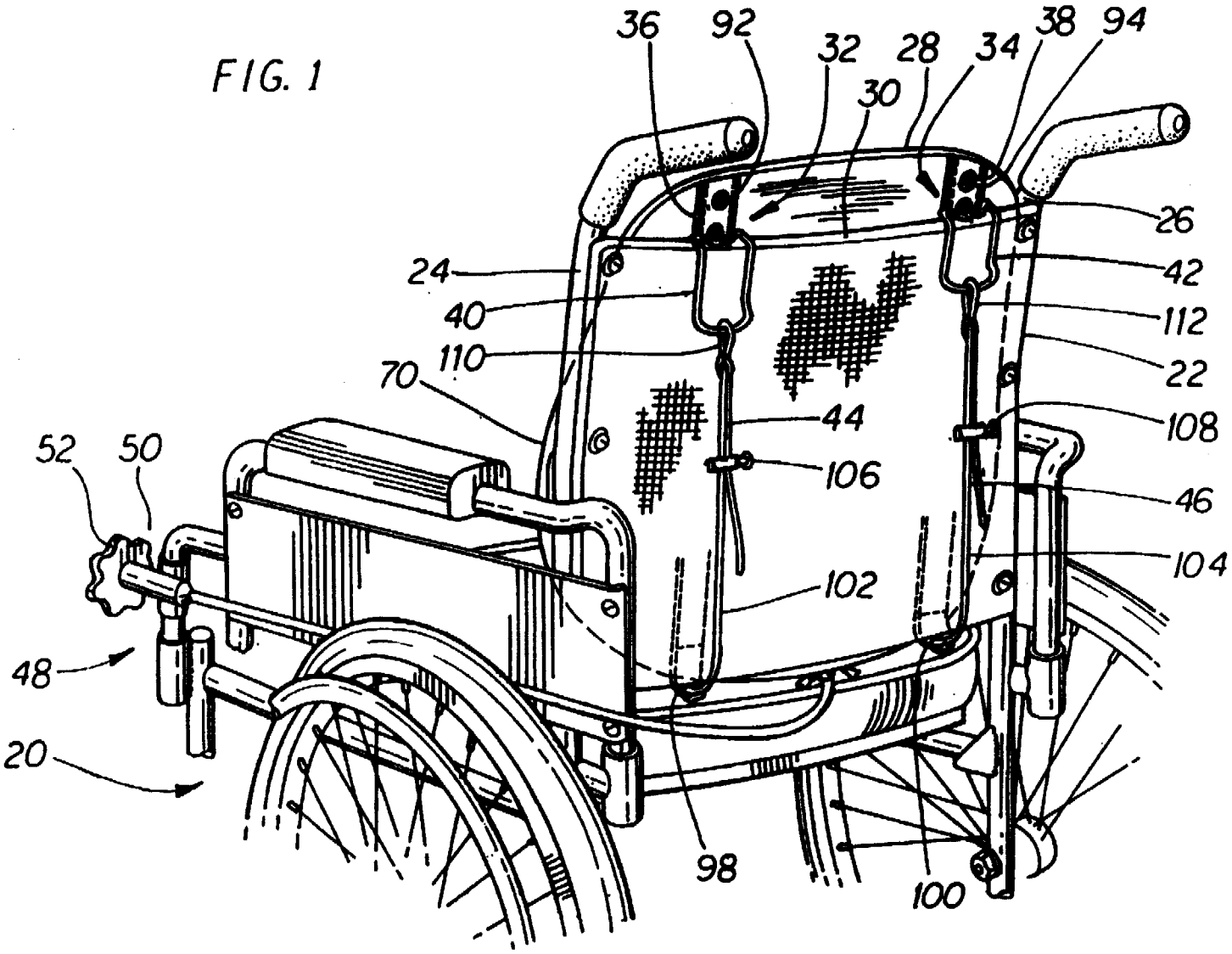
FIG. 1 is a partial perspective view taken generally from the rear and to one side of an exemplary wheelchair having an auxiliary backrest hanging from the fixed backrest in accordance with the invention.

Reference is made firstly to FIG. 1 which illustrates an exemplary wheelchair 20 having a fixed backrest 22 supported in conventional fashion between the upright canes 24, 26 of the wheelchair. An auxiliary backrest 28 is suspended from an upper edge 30 of the fixed ha&rest 22 by a pair of adjustable attachments 32, 34.

As will be described in more detail, the adjustable attachments 32, 34 consist essentially of two elements, namely respective receivers 36, 38 and hangers 40, 42. Preferably, the attachments also include safety devices 44, 46 which, although not essential, are advantageous when the auxiliary backrest is used on a wheelchair. The safety devices 44, 46 help to reduce the possibility of accidental dislodgement of the auxiliary backrest 28 from the fixed backrest 22.

It can also be seen in FIG. 1 that the backrest 28 is provided with an actuator 48 including a controller 50 having a knob 52 which when rotated will vary the vertical curvature of the auxiliary backrest as will be explained.

Figure 2:
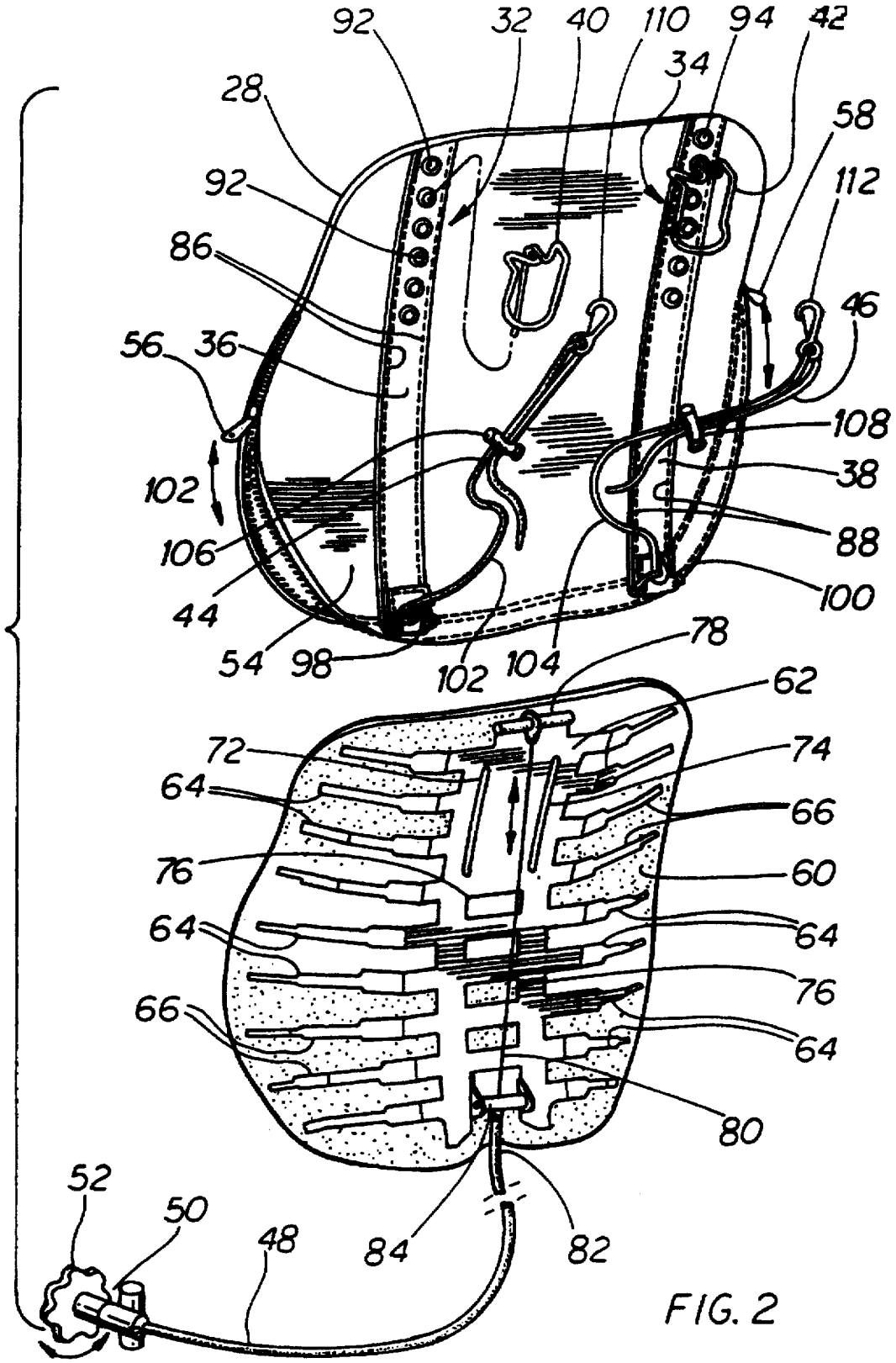
FIG. 2 is an exploded perspective view taken from the rear and to one side of the auxiliary backrest and showing details of an adjustable attachment on the outer cover and a controller for controlling curvature.
Figure 3:
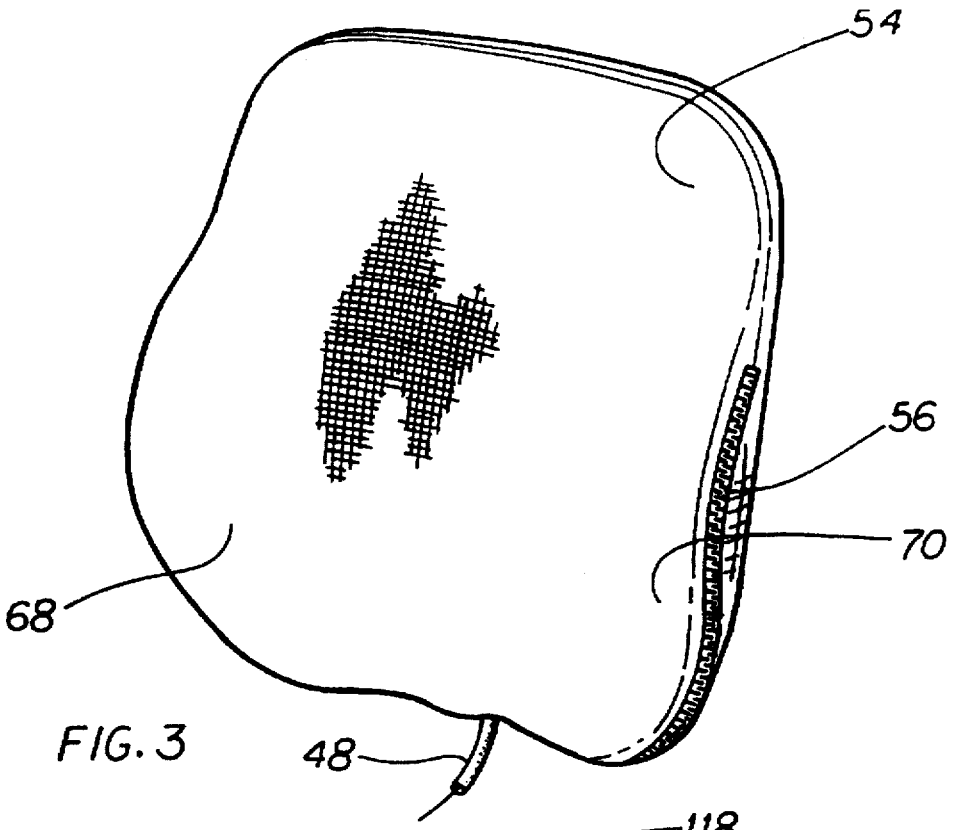
FIG. 3 is a perspective view from the front and to one side of the assembled auxiliary backrest with part of the controller removed.

Reference is next made to FIG. 2 to describe the parts of the auxiliary backrest 28. As seen in FIG. 2, the adjustable attachments 32, 34 are assembled on a cover 54 having a pair of side zippers 56,58 which meet at the bottom about the actuator 48. The cover 54 is shaped to slip over a shaped deformable padding 60 which is attached to a deformable spine 62 extending vertically between the bottom and the top of the auxiliary support. A series of transversely extending ribs 64 depend from the spine and are permanently shaped with angled outer end portions 66 which combine to define lateral supports 68, 70 indicated in FIG. 3.

It will be seen in FIG. 2 that the spine 62 is reinforced by a pair of corrugations 72, 74 at an upper part of the spine and a series of openings 76 are provided towards the lower part of the spine to weaken the spine and thereby ensure that when it is flexed, the flexing will take place in the lower part rather than in the upper part. Of course as flexing takes place, the ribs 66 and outer parts 64 will follow the movement of the curving spine.

Continuing with the lower part of FIG. 2, it will be seen that the upper part of the spine defines a cable anchor 78 from which a cable 80 extends downwardly and into a sheath 82 which meets the spine at a sheath anchor 84. The cable 80 and sheath 82 form part of the actuator 48 and continue to the controller for operating by rotation of the knob 52. The arrangement in the controller is such that when the knob 52 is rotated, the cable 80 is moved inside the sheath either to draw the anchors 78, 84 together thereby curving the spine forwardly, or releasing the cable so that the resilience of the spine will return it to a straighter condition. This gives an infinite variation of curvature in a vertical direction along the spine although the actual shape is controlled by the configuration of corrugations 72, 74 and the positioning and sizing of the opening 76. Of course the strength and resilience of the material will also have an effect.

The upper part of FIG. 2 illustrates the adjustable attachments 32, 34 in more detail than shown in FIG. 1. However FIG. 1 should be used as reference in understanding the structure shown in FIG. 2 since it is shown in use in FIG. 1.

Figure 4:
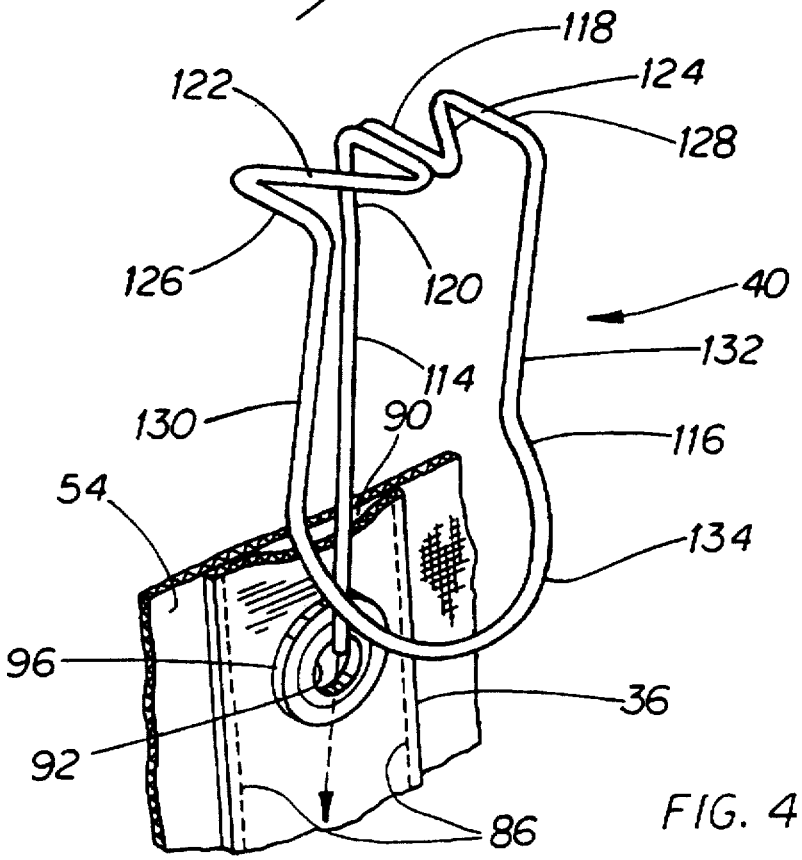
FIG. 4 is a perspective view from the top and to one side of parts of the support structure and drawn to a larger scale than that used in the previous drawings.

The attachment structures 32, 34 include the respective receivers 36, 38 which consist essentially of heavy woven material stitched along parallel vertical edges to the cover 54. FIG. 2 illustrates these stitches at respective pairs of rows 86, 88. As seen in FIG. 4, which illustrates part of receiver 36, the receiver combines with the back part of the cover 54 to define a vertically extending passage 90, the purpose of which will be explained.

Turning to FIG. 2, the receivers 36, 38 define a series of openings 92, 94 extending vertically in a row and reinforced by grommets such as grommet 96 seen in FIG. 4. At the lower ends, the receivers are formed to trap respective D-rings 98, 100 forming parts of the respective safety devices 44, 46. These devices also include respective lanyards 102, 104 which pass upwardly from the D-rings, through releasable locks 106, 108 before looping through respective dips, 110, 112 and returning to the locks. These locks are of a spring-loaded plunger type commonly found on clothing and are released simply by pushing the plunger, moving the lock, and releasing the plunger. Such devices are well known.

It will be clear from FIG. 1, that the clips 110, 112 can be engaged on the hangers 40, 42 to retain the auxiliary backrest 28 in position on the fixed backrest 22.

The hangers 40, 42 can be seen in FIGS. 1 and 2, and reference is now made to FIG. 4 to more fully describe the structure of the hanger which is shown to a larger scale in FIG. 4. The hanger 40 is exemplary of both hangers 40, 42 and consists essentially of an inner part 114 and a compound outer part 116 connected to one another by a bridge 118. In the preferred embodiment, these parts are made from a single piece of round rod welded at the bridge where one end of the rod terminates. The other end of the rod forms the leading end of the inner part 114 which is essentially straight with a slight offset portion 120 leaning slightly forwardly to provide clearance when the bridge 118 is engaged in the grommet 96. This is achieved by entering the leading end of the inner part 114 through the opening 92 and the grommet 96 and into the passage 90. The flexibility of the receiver 36 and the material of the cover 54 permits this and also tends to retain the inner part once it is engaged. With this achieved, the bridge 118 now extends axially through the opening 92 in the grommet 96 and projects outwardly clear of the receiver 36. The bridge extends to the outer portion by way of a pair of divergent and forwardly extending portions 122, 124 which return in a common plane with the bridge 118. Also, from these portions 122, 124 depend parallel portions 126, 128 which are also in the same plane. Consequently, and as seen in FIG. 1, when the hanger is resting on the upper edge 30 of the fixed support, the portions 122 to 128 all rest on this edge to distribute the load of the auxiliary backrest 28 and also to tend to combine with the parallel portions 126, 128 to minimize any likelihood that the hanger will rotate about the inner part.

The parallel portions 126, 128 of the outer part 116 lead downwardly to extending portions 130, 132 which extend generally and parallel with the inner part 114. These portions terminate at a bale 134 which extends slightly rearwardly in order to facilitate engagement over the fixed backrest as the auxiliary backrest is moved downwardly into position.

In use, the adjustable attachments are coupled to a backrest by attaching the receivers to the backrest. The hangers are then positioned through the respective openings in the backrest to determine the height that the auxiliary backrest will be in the chair relative to the fixed backrest. Of course if the wrong selection is made, the hangers can be removed and placed in other openings and tried again until the right position is achieved. The hangers then permit the auxiliary backrest to be dropped downwardly over the fixed backrest without further adjustment.

The preferred material includes spring steel for the spine in order to provide sufficient strength and resilience, and the clip in stainless steel both for durability and to provide suitable strength. The receivers 36, 38 are preferably of a strong woven material and other parts are made as preferred in accordance with normal skill in the art.

Figure 5:
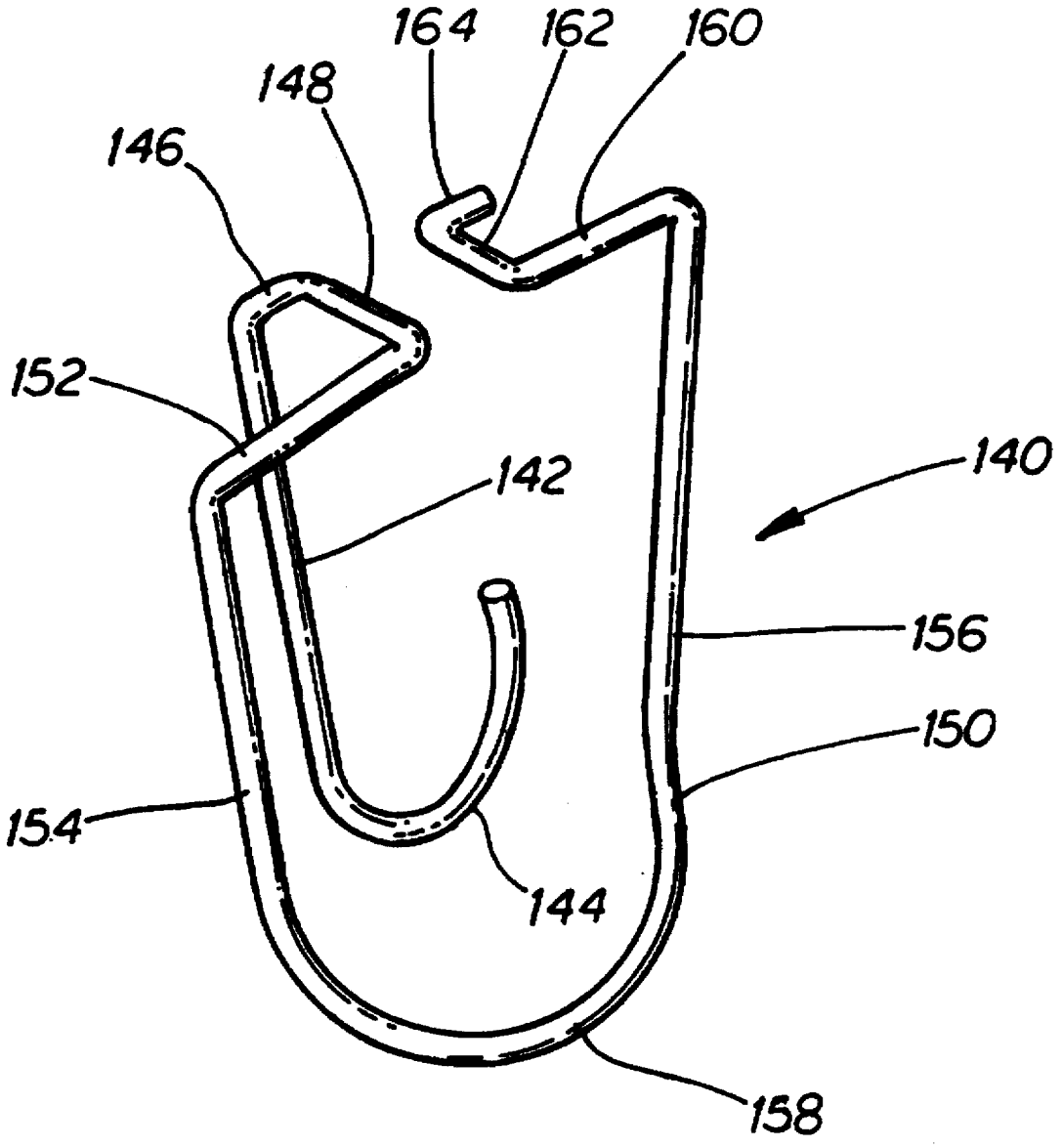
FIG. 5 is a view similar to FIG. 4 and showing an alternative embodiment of hanger.

Reference is next made to FIG. 5 which shows an alternative embodiment of hanger 140 which can be seen, by comparison with FIG. 4, to have similar characteristics to those of hanger 40. However hanger 140 differs in the way it is formed to minimize .any tendency to rock or rotate about a vertical axis when installed. In this embodiment an inner part 142 terminates at a lower hooked end part 144 proportioned to fit snugly in the passage 90 (FIG. 4). At its upper end the part 142 terminates at a short offset 146 extending in the same plane as the end part 144 and the offset meets a bridge 148 connecting the inner part 142 to an outer part 150 lying generally parallel with the inner part 142 and converging slightly towards it in a downward direction. Unlike the outer part 116 of hanger 40 (FIG. 4) the outer part 150 is not a complete loop. The outer part 150 starts from bridge 148, extends along a side part 152 which is parallel to offset 146 and the side part leads to a first one of a pair of downwardly extending portions 154, 156. These portions meet the ends of a bale 158 which is similar to bale 134 (FIG. 4). At its upper end, the portion 156 meets another side part 160 aligned with the side part 152 and ending at a bridge offset 162 which is spaced from and parallel to the bridge 148. The offset 162 ends in a free end piece 164 parallel to the side part 160.

The hanger 140 is used in similar fashion to the hanger 40 already described. However the hanger must be entered upside-down to facilitate entering the free end of the part 144. The hanger is then rotated as it is fed through a selected grommet until the inner part is within passage 90 (FIG. 4) and the bridge 148 is in a grommet 96. The hanger is then well located because the end part 144 extends across the passage 90 and this limits any tendency for the hanger to rotate about a vertical axis. Also the proportions of the offset 162 relative to the bridge 148 are chosen to bring the free end piece 164 into firm engagement with the cover 54 to further stabilize the assembly.

The hanger 140 is also preferably made from stainless steel rod.

It will be clear from the foregoing description, and as indicated earlier, the adjustable attachments can be used for a number of different purposes including those described. This is all within the scope of the invention. It is also envisaged that the preferred embodiment is a particularly useful and advantageous use of the combination of an adjustable auxiliary backrest with adjustable attachments. A similar structure could be used for instance on secretarial chairs and, with suitable change in shape of the hangers, on automobile seats, etc. All of this is within the scope of the invention and the invention should not be limited by the appearance of the preferred embodiment. The scope of the invention is to be determined from the claims.

We claim:

1. An adjustable attachment for suspending an object from a supporting structure which has an upper edge from which the object is to hang, the attachment comprising:

an elongate receiver extending longitudinally and having a plurality of openings spaced apart along the length of the receiver to form a row of openings, the receiver further including structure for coupling the receiver to the object at both sides of the row of openings; and a hanger having an inner part adapted to be engaged through a respective one of said openings and positionable longitudinally of the receiver, a bridge attached orthogonally to the hanger for positioning in said one of said openings with the inner part so positioned, and an outer part extending generally in parallel with the inner part and attached to the bridge whereby in use the hanger can be engaged through a selected one of the openings until the bridge is positioned in the opening whereupon the hanger extends along the length of the receiver and the outer part can be engaged downwardly over said upper edge until the bridge meets the upper edge and the object is then hanging from the supporting structure held in position by the adjustable attachment.

2. An adjustable attachment as claimed in claim 1 in which the inner part of the hanger is a central element and the outer part includes two side elements spaced to either side of the central element.

3. An adjustable attachment as claimed in claim 2 in which the bridge includes a central part for extending through one of said openings, and divergent side parts extending inwardly and apart for resting on said upper edge to distribute loading on the upper edge.

4. An adjustable attachment as claimed in claim 1 in which the inner part terminates at a hooked end part for engagement in the receiver to better stabilize the hanger.

5. An adjustable attachment as claimed in claim 3 in which the hanger is made from a single piece of round metal rod.

6. An adjustable attachment as claimed in claim 1 in which said elongate receiver is a woven fabric.

7. An adjustable attachment as claimed in claim 6 in which said structure for coupling the receiver to said object is two portions of the woven fabric to facilitate stitching the receiver to the object thereby forming an elongate passage between the fabric and the object to contain the inner part of the hanger.

8. An adjustable attachment as claimed in claim 1 and further including a safety device attachable to the object and to the hanger and adjustable to pull downwardly on the hanger with the hanger in place to thereby minimize the likelihood of the hanger becoming separated accidentally from the receiver.

9. An adjustable attachment as claimed in claim 8 in which said device comprises a lanyard, means adapted to attach the lanyard to the object, a releasable dip for attaching the device to the hanger and adjustment means on the lanyard to tighten and release the safety device.

10. An adjustable attachment as claimed in claim 2 in which the hanger further includes a bale part attached to and extending downwardly and outwardly from said outer parts.

* * * * *